US010029144B2

(12) United States Patent
Noguchi et al.

(10) Patent No.: US 10,029,144 B2
(45) Date of Patent: Jul. 24, 2018

(54) ORAL CAVITY FUNCTION TRAINING TOOL

(71) Applicant: JMS Co., Ltd., Hiroshima (JP)

(72) Inventors: Yusuke Noguchi, Hiroshima (JP); Koichiro Toyota, Hiroshima (JP)

(73) Assignee: JMS CO., LTD., Hiroshima (JP)

( * ) Notice: Subject to any disclaimer, the term of this patent is extended or adjusted under 35 U.S.C. 154(b) by 0 days.

(21) Appl. No.: 15/022,719

(22) PCT Filed: Sep. 18, 2013

(86) PCT No.: PCT/JP2013/005513
§ 371 (c)(1),
(2) Date: Mar. 17, 2016

(87) PCT Pub. No.: WO2015/040651
PCT Pub. Date: Mar. 26, 2015

(65) Prior Publication Data

US 2016/0228741 A1 Aug. 11, 2016

(51) Int. Cl.

| | |
|---|---|
| ***A63B 23/03*** | (2006.01) |
| ***A61H 23/00*** | (2006.01) |
| ***A63B 21/02*** | (2006.01) |
| *A63B 22/00* | (2006.01) |

(52) U.S. Cl.
CPC ..... *A63B 23/032* (2013.01); *A61H 23/004* (2013.01); *A63B 21/021* (2015.10); *A61H 2201/1604* (2013.01); *A61H 2201/165* (2013.01); *A61H 2205/02* (2013.01); *A63B 2022/0092* (2013.01)

(58) Field of Classification Search
CPC . A63B 23/03–23/03591; A63B 21/02–21/028; A63B 2022/0092; A61H 23/004; A61H 2201/1604; A61H 2205/02; A61H 2201/165
USPC ..... 482/10, 11, 121, 122, 128, 129
See application file for complete search history.

(56) References Cited

U.S. PATENT DOCUMENTS

| | | | | |
|---|---|---|---|---|
| 2,517,457 A | | 8/1950 | Allen | |
| 2,520,773 A | | 8/1950 | Müller | |
| 4,718,662 A | * | 1/1988 | North | A63B 23/032 128/860 |
| 5,133,740 A | | 7/1992 | Kussick | |
| 5,213,553 A | * | 5/1993 | Light | A61F 5/58 434/185 |

(Continued)

FOREIGN PATENT DOCUMENTS

| | | | |
|---|---|---|---|
| FR | 970352 | A | 1/1951 |
| JP | 2001-510694 | A | 8/2001 |

(Continued)

OTHER PUBLICATIONS

International Search Report of PCT/JP2013/005513 dated Oct. 15, 2013.

*Primary Examiner* — Garrett Atkinson
(74) *Attorney, Agent, or Firm* — Maschoff Brennan

(57) ABSTRACT

An exercise tool 1 for improving oral function inserted and used in an oral cavity includes: a base 10 inserted in the oral cavity; and a hollow bulge 20 which is made of an elastic body and protrudes from the base 10. Level difference portions 41-43 and 51-53 are provided in a vertically intermediate region of at least one of an outer surface and an inner surface of the bulge 20.

8 Claims, 10 Drawing Sheets

(56) References Cited

U.S. PATENT DOCUMENTS 5,562,105 A * 10/1996 Syrop ..... A61C 19/04 128/845
5,899,691 A * 5/1999 Parker ..... A63B 23/032 128/861
6,406,404 B1 * 6/2002 Chu ..... A63B 23/032 482/11
6,524,225 B1 * 2/2003 Arias ..... A63B 23/032 482/11
6,607,549 B2 * 8/2003 Huang ..... A63B 23/032 482/11
7,083,548 B1 * 8/2006 Moore ..... A63B 21/0023 482/11
7,238,145 B2 * 7/2007 Robbins ..... A63B 21/0004 482/11
7,678,271 B2 * 3/2010 Curtin ..... A47J 43/22 141/337
7,857,831 B2 * 12/2010 Ishikawa ..... A63B 23/18 128/861
7,955,221 B2 * 6/2011 Loveday ..... A63B 23/032 482/10
8,105,210 B2 * 1/2012 Seybold ..... A63B 23/032 128/861
D669,750 S * 10/2012 Lee ..... D7/700
8,376,912 B1 * 2/2013 Dedvukaj ..... A63B 23/032 482/11
D688,019 S * 8/2013 Lee ..... D32/55
D714,105 S * 9/2014 Lee ..... D7/667
D718,579 S * 12/2014 Lee ..... D7/667
9,044,082 B2 * 6/2015 Kusuma ..... A45F 3/20
9,669,557 B2 * 6/2017 Golomb ..... B26D 3/26
9,723,942 B2 * 8/2017 Do ..... A47J 31/0626
2002/0026715 A1 3/2002 Bohm-Van Diggelen
2002/0165568 A1 * 11/2002 Huang ..... A63B 23/032 606/191
2010/0222706 A1 * 9/2010 Miyahara ..... A61B 5/038 600/590

FOREIGN PATENT DOCUMENTS

JP 2004-121606 A 4/2004
JP 2006034916 A 2/2006
JP 2006-345945 A 12/2006
JP 2007319303 A 12/2007
JP 2008067732 A 3/2008
JP 2011083524 A 4/2011
JP 2013192698 A 9/2013
WO WO/2012/090507 A1 7/2012
WO WO/2012/111269 A1 8/2012

* cited by examiner

ORAL CAVITY FUNCTION TRAINING TOOL

TECHNICAL FIELD

The present invention relates to an exercise tool for strengthening oral muscles such as a tongue and facial muscles.

BACKGROUND ART

If oral function deteriorates with aging or due to other causes such as a stroke, a masticatory force and/or a swallowing force may be weakened, and thus food or beverage swallowed may easily be sucked into the trachea (hereinafter this phenomenon is referred to as "aspiration"). The aspiration may possibly cause aspiration pneumonia. Since the aspiration pneumonia is one of major causes of death for senior citizens, preventing the aspiration of patients and senior citizens is one of urgent issues.

Attempts have been made to improve the oral function by performing an exercise for strengthening oral muscles of a person whose swallowing function has been deteriorated. Specifically, an exercise is generally performed to improve muscles of lips and a tongue and their elaborate movements.

In this exercise, a general-purpose product such as a gauze sheet or a button modified to meet the purpose of the exercise is generally used. However, in recent years, an exercise tool developed for enhancing the effect of the exercise may be used in some cases (see, e.g., Patent Documents 1 and 2).

An exercise tool of Patent Document 1 has a spoon-shaped stimulating portion and a grip portion which a user holds. An exercise is performed by, for example, pushing upward the stimulating portion inserted in an oral cavity with a tongue.

An exercise tool of Patent Document 2 has a push portion to be pushed upward by a tongue and a bar portion which a user holds. An exercise is performed by pushing the push portion upward with a tongue.

CITATION LIST

Patent Documents

[Patent Document 1] Japanese Unexamined Patent Publication No. 2007-319303

[Patent Document 2] Japanese Unexamined Patent Publication No. 2011-83524

SUMMARY OF THE INVENTION

Technical Problem

To do an exercise using the exercise tool of Patent Document 1, the stimulating portion is pushed upward by the tongue as described above. However, a user cannot tell easily how much the stimulating portion should be pushed upward to do an effective exercise. Further, the user cannot realize easily that he or she is doing the exercise properly by merely pushing the stimulating portion upward.

Also when the exercise tool of Patent Document 2 is used, it is not easy to tell how much the push portion should be pushed upward by the tongue to do an effective exercise. Thus, the user cannot realize easily that he or she is doing the exercise properly.

That is, when the conventional exercise tools are used, it is not easy to tell whether the exercise is effectively done or not, and in addition, the user's motivation may be reduced because of lack of realization that the exercise is properly done.

In view of the foregoing, it is therefore an object of the present invention to allow a user to do an effective exercise for improving oral function and to realize during the exercise that he or she is doing the exercise properly so as to increase the user's motivation, thereby improving the oral function.

Solution to the Problem

To achieve the object, according to the present invention, if a force applied by a tongue reaches or exceeds a predetermined level required for doing the exercise, a person doing the exercise is stimulated by vibration.

A first aspect of the invention is directed to an exercise tool for improving oral function inserted and used in an oral cavity. The exercise tool includes: a base inserted in the oral cavity; and a hollow bulge which is made of an elastic body and protrudes from the base. A level difference portion is provided in an intermediate region of at least one of an outer surface and an inner surface of the bulge in a protruding direction thereof.

This configuration allows for locating the bulge at a predetermined position in the oral cavity, such as between a tongue and a hard palate, by inserting the base in the user's oral cavity. If the tongue is pushed upward in this state, the bulge is sandwiched between the tongue and the hard palate and a force is exerted on the bulge to vertically crush the bulge. If the force applied by the tongue reaches or exceeds a predetermined level, a level difference portion provided in a vertically intermediate region of the bulge serves as a starting point of the elastic deformation, and the bulge undergoes a sudden elastic deformation such that a portion of the bulge closer to a distal end thereof than the level difference portion approaches a proximal end thereof. The bulge vibrates at the instant when the bulge undergoes the sudden elastic deformation, the vibration is transferred to the tongue and the hard palate, and thus the user feels the vibration. When the force applied by the tongue is released with the bulge being elastically deformed as described above, the bulge recovers its original shape due to its elasticity. Repeating the raising and lowering of the tongue allows for strengthening oral and facial muscles.

That is, when doing an exercise, what the user needs to do is simply press the bulge with his or her tongue until the vibration occurs. Thus, the user is able to know clearly how much he or she should press the bulge to obtain the effect of the exercise, and an effective exercise is achievable. Further, the occurrence of the vibration allows the user to realize that he or she is doing the exercise properly.

A second aspect of the invention is an embodiment of the first aspect of the invention. In the second aspect, a peripheral wall of the bulge includes a first peripheral wall portion inclined at a first inclination angle relative to the protruding direction, and a second peripheral wall portion inclined relative to the protruding direction at a second inclination angle smaller than the first inclination angle, and the first and second peripheral wall portions are continuous in the protruding direction of the bulge, and constitute the level difference portion.

That is, when the exercise tool is in use, for example, a force applied by a tongue is exerted substantially in the same direction as the protruding direction of the bulge. When the exercise tool is in use, the first peripheral wall portion inclined at a relatively large inclination angle relative to the protruding direction is deformed more easily than the second peripheral wall portion. Since the first peripheral wall portion serves as a portion to be deformed easily, the first peripheral wall portion is deformed with reliability with the level difference portion serving as a starting point of the deformation, and thus the vibration is clearly generated by the deformation. On the other hand, when the force applied by the tongue is released, the first peripheral wall portion starts to recover its original shape under the action of an elastic force. Thus, the bulge recovers its original shape with reliability.

A third aspect of the invention is an embodiment of the second aspect of the invention. In the third aspect, the first peripheral wall portion has a greater length in the protruding direction than the second peripheral wall portion.

According to this configuration, the first peripheral wall portion is deformed more easily than the second peripheral wall portion. Thus, the vibration is generated clearly.

A fourth aspect of the invention is an embodiment of any one of the first to third aspects of the invention. In the fourth aspect, the level difference portion is provided in each of the outer and inner surfaces of the bulge.

According to this configuration, when a force applied by a tongue reaches or exceeds a predetermined level, both of the inner and outer level difference portions of the bulge serve as a starting point of the deformation. Thus, the sudden elastic deformation of the bulge occurs more easily, and the vibration is clearly generated by the deformation. This allows the user to recognize clearly that he or she is doing the exercise properly.

A fifth aspect of the invention is an embodiment of any one of the first to fourth aspects of the invention. In the fifth aspect, the exercise tool further includes an outer level difference portion provided in the outer surface of the bulge and an inner level difference portion provided in the inner surface of the bulge. A valley of the outer level difference portion and a valley of the inner level difference portion are misaligned with each other in the protruding direction of the bulge, and a portion of the bulge between the valleys of the outer and inner level difference portions is thinner than the other portions of the bulge.

According to this configuration, a portion of the bulge between the valleys of the outer and inner level difference portions is made thin. As a result, the bulge is provided with a less rigid portion. Thus, the sudden elastic deformation of the bulge occurs more easily as compared with the case where every portion of the bulge has the same thickness. When the bulge is elastically deformed, the vibration is generated with reliability.

A sixth aspect of the invention is an embodiment of the second aspect of the invention. In the sixth aspect, the first and second peripheral wall portions are configured to overlap with each other when a force is exerted on the bulge in a direction in which the bulge is crushed, and a projection is formed on at least one of outer surfaces of the first and second peripheral wall portions so that the projection comes into contact with the other outer surface when the first and second peripheral wall portions overlap with each other.

According to this configuration, when a force is exerted on the bulge in a direction in which the bulge is crushed, the bulge is elastically deformed so that the first and second peripheral wall portions overlap with each other. In this state, a projection formed on one of the outer surfaces comes into contact with the other outer surface to prevent excessive deformation of the bulge. The contact of the projection exerts a force in a direction in which both of the wall portions return to their original shape, thereby allowing the bulge to recover its original shape with reliability.

A seventh aspect of the invention is an embodiment of the fourth aspect of the invention. In the seventh aspect, the exercise tool further includes an outer level difference portion provided in the outer surface of the bulge and an inner level difference portion provided in the inner surface of the bulge. A valley of the outer level difference portion and a valley of the inner level difference portion are misaligned with each other in the protruding direction of the bulge, and if a distance between the valleys of the outer and inner level difference portions in a direction orthogonal to the protruding direction is regarded as X and a distance between the valleys of the outer and inner level difference portions in the protruding direction is regarded as Y, X is not more than Y.

That is, with the relationship between the distances between the valleys of the outer and inner level difference portions set as described above, the sudden elastic deformation of the bulge occurs more easily as compared with the case where X is more than Y.

An eighth aspect of the invention is an embodiment of the seventh aspect of the invention. In the eighth aspect, X is not more than ⅓ of Y.

According to this configuration, the bulge which has received a force easily undergoes a more sudden elastic deformation.

A ninth aspect of the invention is an embodiment of any one of the first to eighth aspects of the invention. In the ninth aspect, if a maximum load applied before the bulge is elastically deformed with the level difference portion serving as a starting point of the deformation is regarded as W1 and a minimum load applied just after the bulge is elastically deformed is regarded as W2, W2 is not more than ½ of W1.

That is, if the minimum load W2 is more than ½ of the maximum load W1, the vibration generated when the bulge undergoes a sudden elastic deformation is small, which may be difficult for some users to feel. However, if W2 is not more than ½ of W1, the vibration is generated so clearly that various types of users can feel it.

Advantages of the Invention

According to the first aspect of the invention, a level difference portion is provided in at least one of outer and inner surfaces of a hollow bulge made of an elastic body. Thus, when a force is gradually applied to the bulge by a tongue, the bulge undergoes a sudden elastic deformation with the level difference portion serving as a starting point of the deformation. This allows a user to do an effective exercise for improving oral function and to realize during the exercise that he or she is doing the exercise properly so as to increase the user's motivation. As a result, the oral function is effectively improvable.

Further, the exercise tool also allows for strengthening muscles around the oral cavity. This may also provide beauty effects, such as tightening the face.

According to the second aspect of the invention, a level difference portion is formed by the first peripheral wall portion of the bulge and the second peripheral wall portion inclined at a smaller inclination angle than the first peripheral wall portion. Thus, vibration is generated clearly by the deformation of the first peripheral wall portion inclined at a relatively large inclination angle, and the bulge is able to recover its original shape more easily.

According to the third aspect of the invention, the first peripheral wall portion is longer than the second peripheral wall portion in the protruding direction of the bulge, and thus the first peripheral wall portion is deformed more easily than the second peripheral wall portion. This allows for generating clear vibration, and the user is able to realize clearly that he or she is doing the exercise properly.

According to the fourth aspect of the invention, a level difference portion is provided in each of the outer and inner surfaces of the bulge. This allows for causing a sudden elastic deformation of the bulge easily. Thus, the user is able to realize clearly that he or she is doing the exercise properly.

According to the fifth aspect of the invention, a portion of the bulge between the valleys of the outer and inner level difference portions is made thin. This allows for causing a sudden elastic deformation of the bulge easily, and generating the vibration clearly. Further, the bulge is allowed to recover its original shape with reliability when a force applied by the tongue is released.

According to the sixth aspect of the invention, a projection is formed on at least one of outer surfaces of the first and second peripheral wall portions so that the projection comes into contact with the other outer surface when the first and second peripheral wall portions overlap with each other. This allows the bulge to recover its original shape with reliability.

According to the seventh aspect of the invention, a level difference portion is provided in each of the outer and inner surfaces of the bulge. If a distance between the valleys of the outer and inner level difference portions in a direction orthogonal to the protruding direction is regarded as X and a distance between the valleys of the outer and inner level difference portions in the protruding direction is regarded as Y, X is not more than Y. Thus, when the exercise tool is in use, a sudden elastic deformation of the bulge occurs more easily, and the user is able to realize more clearly that he or she is doing the exercise properly.

According to the eighth aspect of the invention, X is not more than ⅓ of Y. Thus, when the exercise tool is in use, a more sudden elastic deformation of the bulge occurs, and thus the user is able to realize more clearly that he or she is doing the exercise properly.

According to the ninth aspect of the invention, a minimum load W2 applied just after the bulge is elastically deformed is not more than ½ of a maximum load W1. Thus, when the exercise tool is in use, the vibration generated by the bulge is increasable, and the user is able to realize more clearly that he or she is doing the exercise properly.

DESCRIPTION OF EMBODIMENTS

Embodiments of the present invention will be described in detail with reference to the drawings. Preferred embodiments to be described below are merely illustrative ones in nature, and do not intend to limit the scope of the present invention or applications or uses thereof.

Figure 2:
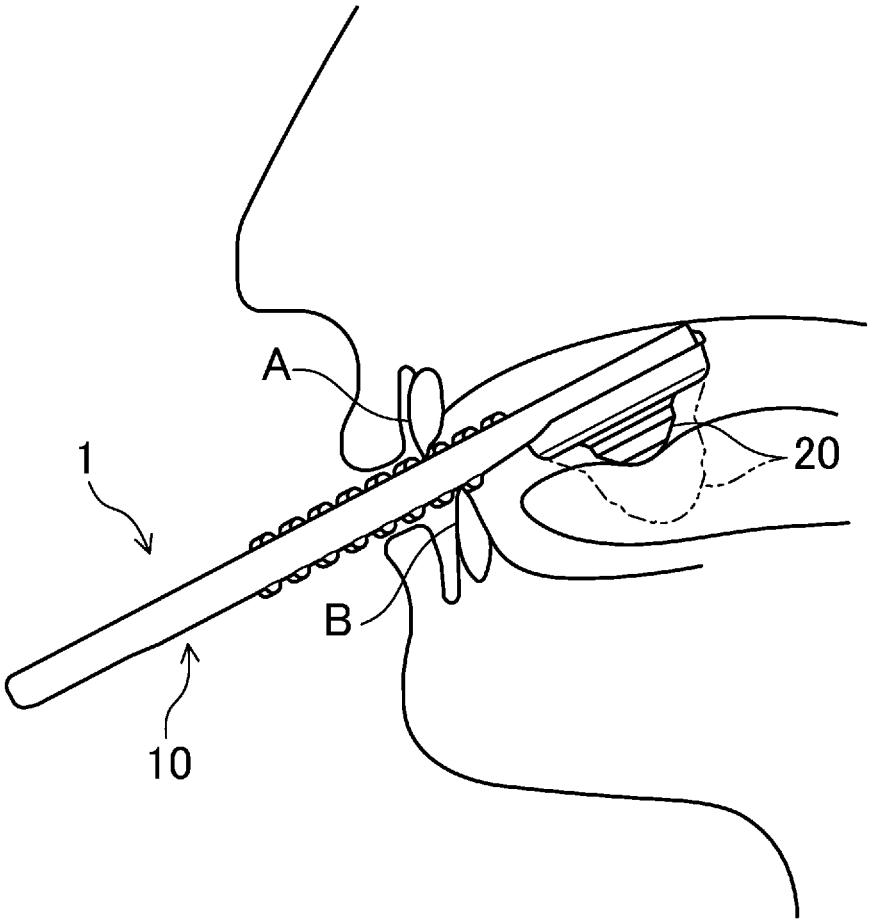
FIG. 2 is a view illustrating the exercise tool for improving the oral function according to the first embodiment in use.

In the context of this specification, a "vertical direction" is a direction in which a bulge 20 (to be described later) of an exercise tool 1 of the present invention for improving oral function, inserted in an oral cavity of a person who does an exercise (a user), is crushed by the user's tongue and hard palate as shown in FIG. 2, and a "horizontal direction" is a horizontal direction relative to a person who does the exercise using the exercise tool 1 inserted in his or her oral cavity.

First Embodiment

Figure 1:
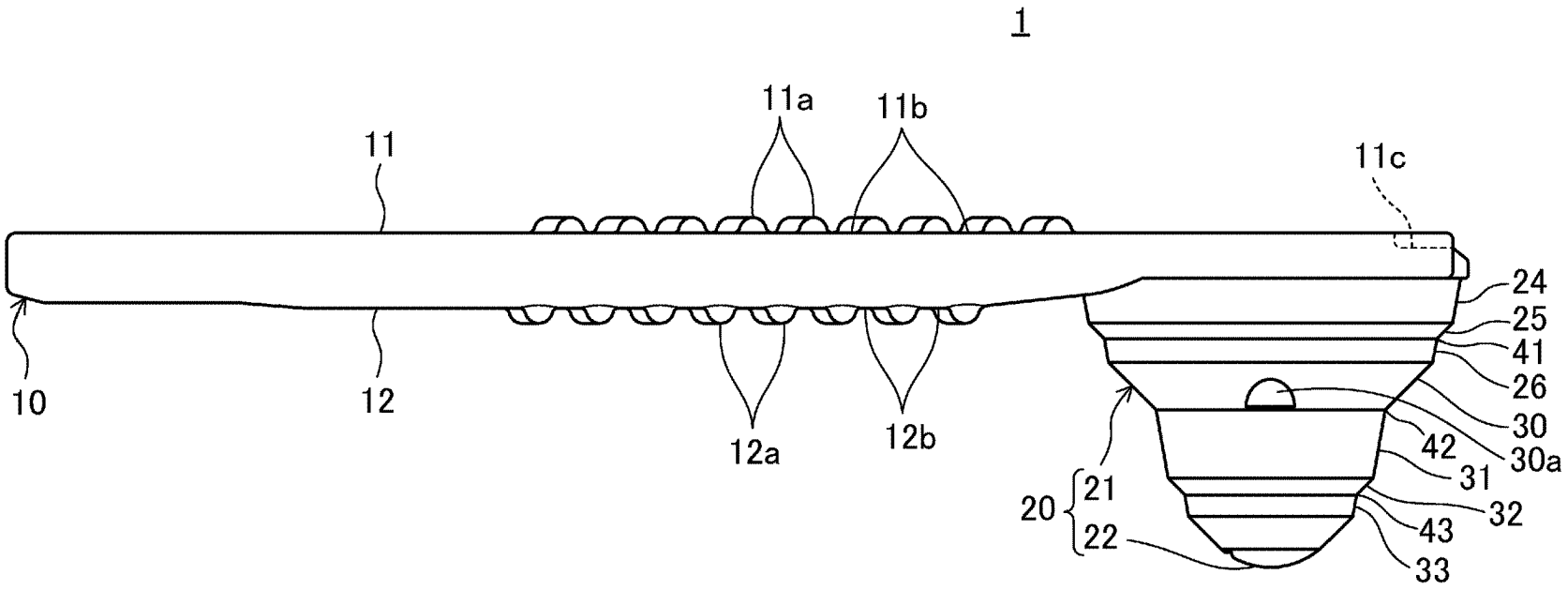
FIG. 1 is a side view illustrating an exercise tool for improving oral function according to a first embodiment.

FIG. 1 shows an exercise tool 1 for improving oral function according to a first embodiment of the present invention. The exercise tool 1 is used to do an exercise to strengthen oral and facial muscles. In particular, the exercise tool 1 is suitable for doing an exercise mainly for improving muscles of lips and a tongue and their elaborate movements.

Subjects of the exercise using the exercise tool 1 include, for example, those having a swallowing function deteriorated due to diseases such as a stroke, and those having a swallowing function deteriorated with aging. However, the subjects are not limited to such people, and may include those having a swallowing function deteriorated and those with a risk of deterioration of the swallowing function.

Figure 3:
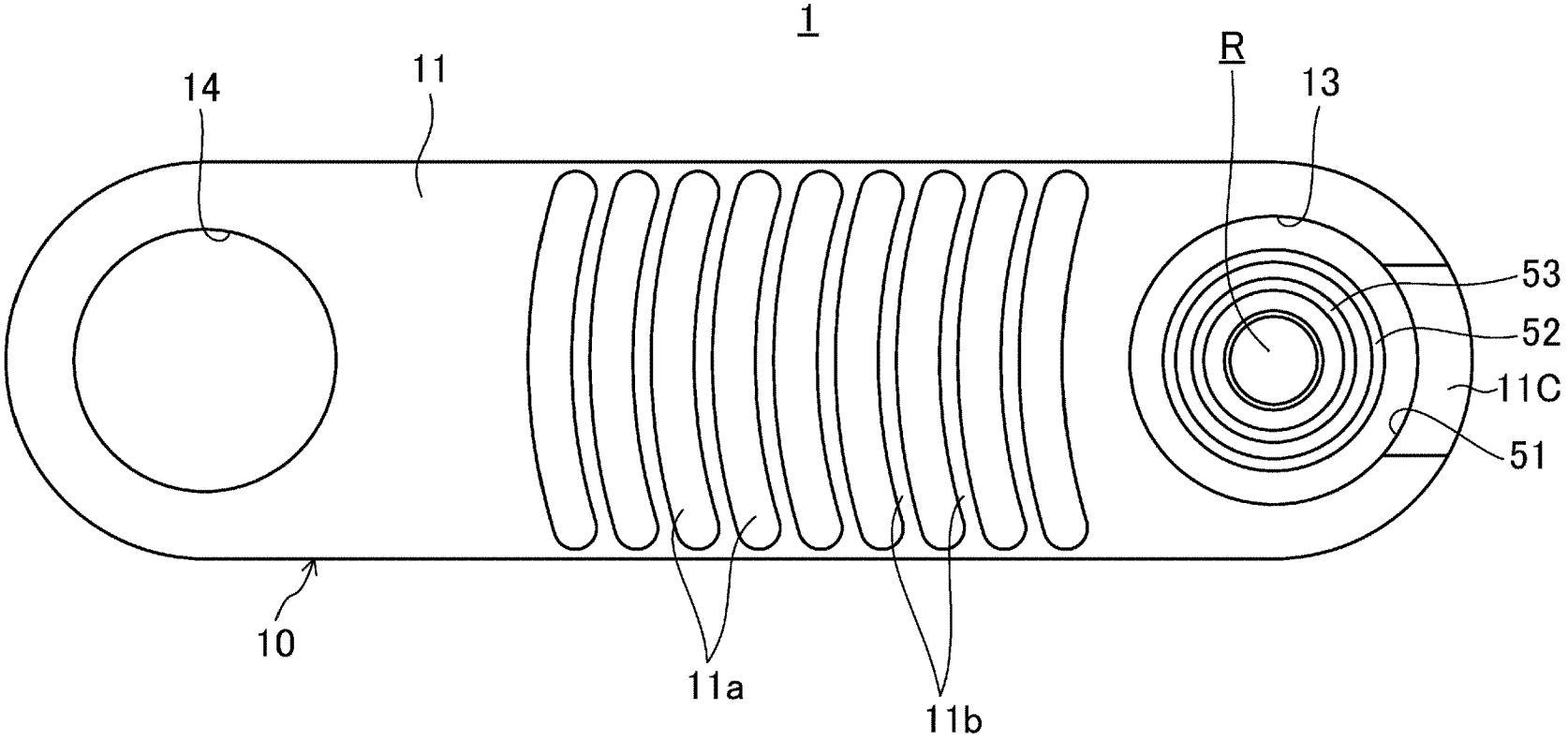
FIG. 3 is a plan view illustrating the exercise tool for improving the oral function according to the first embodiment.
Figure 4:
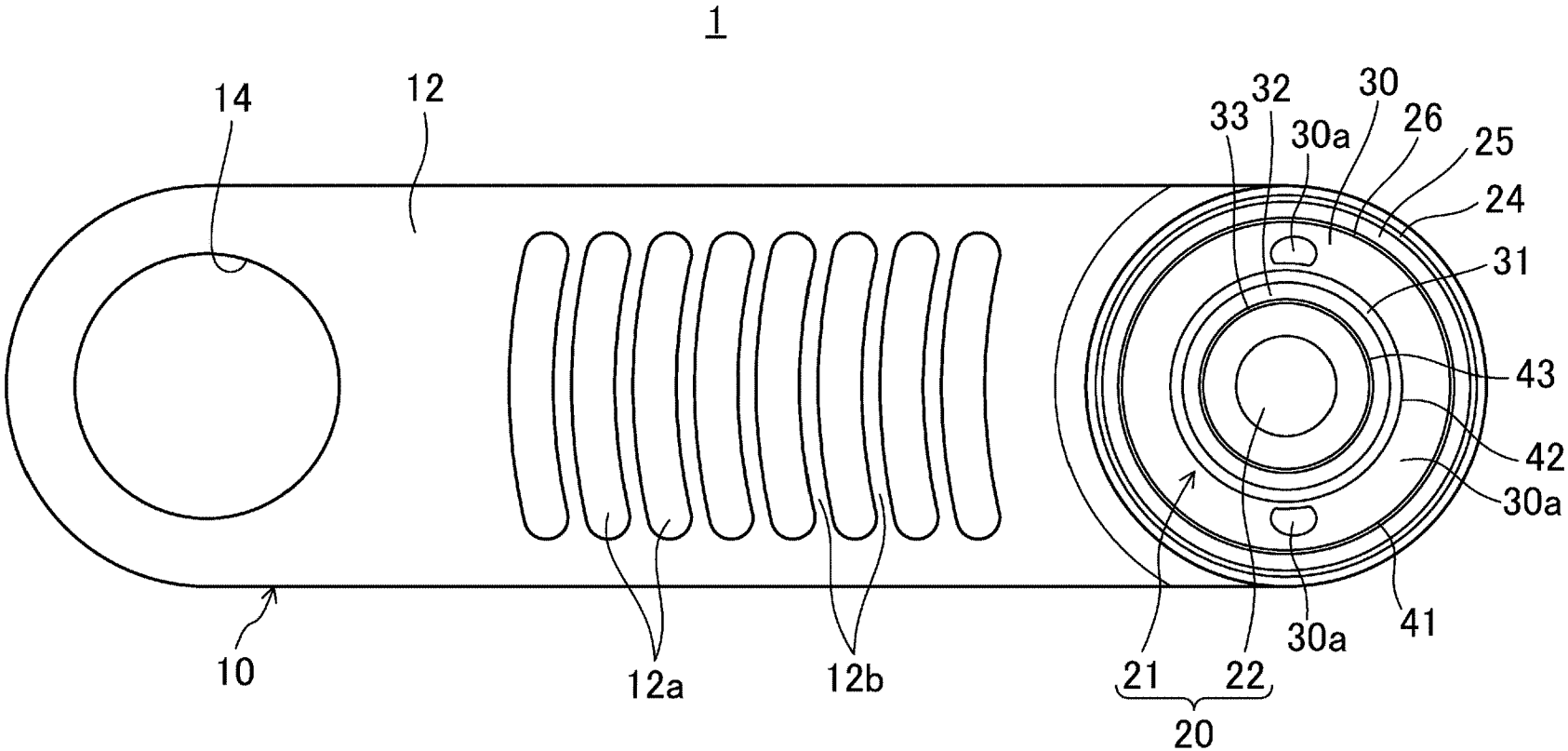
FIG. 4 is a bottom view illustrating the exercise tool for improving the oral function according to the first embodiment.

As shown in FIGS. 3 and 4, the exercise tool 1 includes a base 10 for fixing the tool to the user while doing the exercise for improving the oral function, and a bulge 20 provided on the base 10 as a portion to be elastically deformed. The base 10 and the bulge 20 are molded as an integral piece made of an elastic material. Such a material may include, for example, silicone rubber, polypropylene, polyethylene, polyvinyl chloride, thermoplastic elastomers, and natural rubber. However, the material is not limited to them, and any types of elastic materials may be used as long as their hardness is in a range in which the material is deformed when it receives a force (a load) applied by a tongue. The hardness is preferably shore A hardness in the range of 30 to 60 (measured by a durometer). An elastomer is preferably used because it is inexpensive, easy to mold, and highly safe for human bodies.

The base 10 is in the shape of a plate. The base 10 has a width (a horizontal dimension) of 20 to 30 mm, for example, and a length of 80 to 90 mm. These dimensions are merely examples, and may be varied depending on the user's sex, physique, or any other factors.

As shown in FIG. 2, when the exercise tool 1 is in use, one of longitudinal ends of the base 10 is inserted in an oral cavity, while the other longitudinal end is located outside the oral cavity. As shown in FIGS. 3 and 4, the one of the longitudinal ends (a right end in FIGS. 3 and 4) of the base 10 has an arc-shaped edge. This shape corresponds to the outer edge of the bulge 20. The other longitudinal end (a left end in FIGS. 3 and 4) of the base 10 also has an arc-shaped edge.

As shown in FIG. 1, an upper surface 11 of the base 10 is provided with a plurality of upper ribs 11*a*. As shown in FIG. 3, each of the upper ribs 11*a* extends in a width direction of the base 10, and is gently curved in the form of an arc when viewed in plan. The arc shape of the upper ribs 11*a* corresponds to the row of front teeth A, B (shown in FIG. 2) of an adult, for example. The upper ribs 11*a* are arranged at intervals in a longitudinal direction of the base 10. An upper groove 11*b* is formed between each pair of the upper ribs 11*a* adjacent to each other in the longitudinal direction of the base 10. The upper front teeth A of the user fit in the upper groove 11*b* as described in detail later.

As shown in FIG. 1, a lower surface 12 of the base 10 is also provided with a plurality of lower ribs 12*a*. The number of the lower ribs 12*a* is larger than the number of the upper ribs 11*a*, and an area of the lower surface of the base 10 occupied by the lower ribs 12*a* is larger than an area of the upper surface of the base 10 occupied by the upper ribs 11*a*.

The lower ribs 12*a* have substantially the same curvature as the upper ribs 11*a*, and are longer than the upper ribs 11*a*. With the provision of the lower ribs 12*a*, the lower surface 12 of the base 10 is also provided with a plurality of lower grooves 12*b*. As described in detail later, the lower front teeth B of the user fit in the lower groove 12*b*.

The upper and lower ribs 11*a* and 12*a* are arranged to be misaligned with each other in the longitudinal direction of the base 10. That is, the lower ribs 12*a* are not located immediately below the upper ribs 11*a*. Thus, the upper and lower grooves 11*b* and 12*b* are also misaligned with each other in the longitudinal direction of the base 10. A misalignment between the upper and lower grooves 11*b* and 12*b* is determined by taking a general misalignment between lower ends of the upper front teeth A and upper ends of lower front teeth B of an adult into account. For example, the misalignment may be 1 to 2 mm. The misalignment between the upper and lower grooves 11*b* and 12*b* corresponds to the misalignment between the lower ends of the upper front teeth A and the upper ends of the lower front teeth B in the longitudinal direction of a user.

Figure 5:
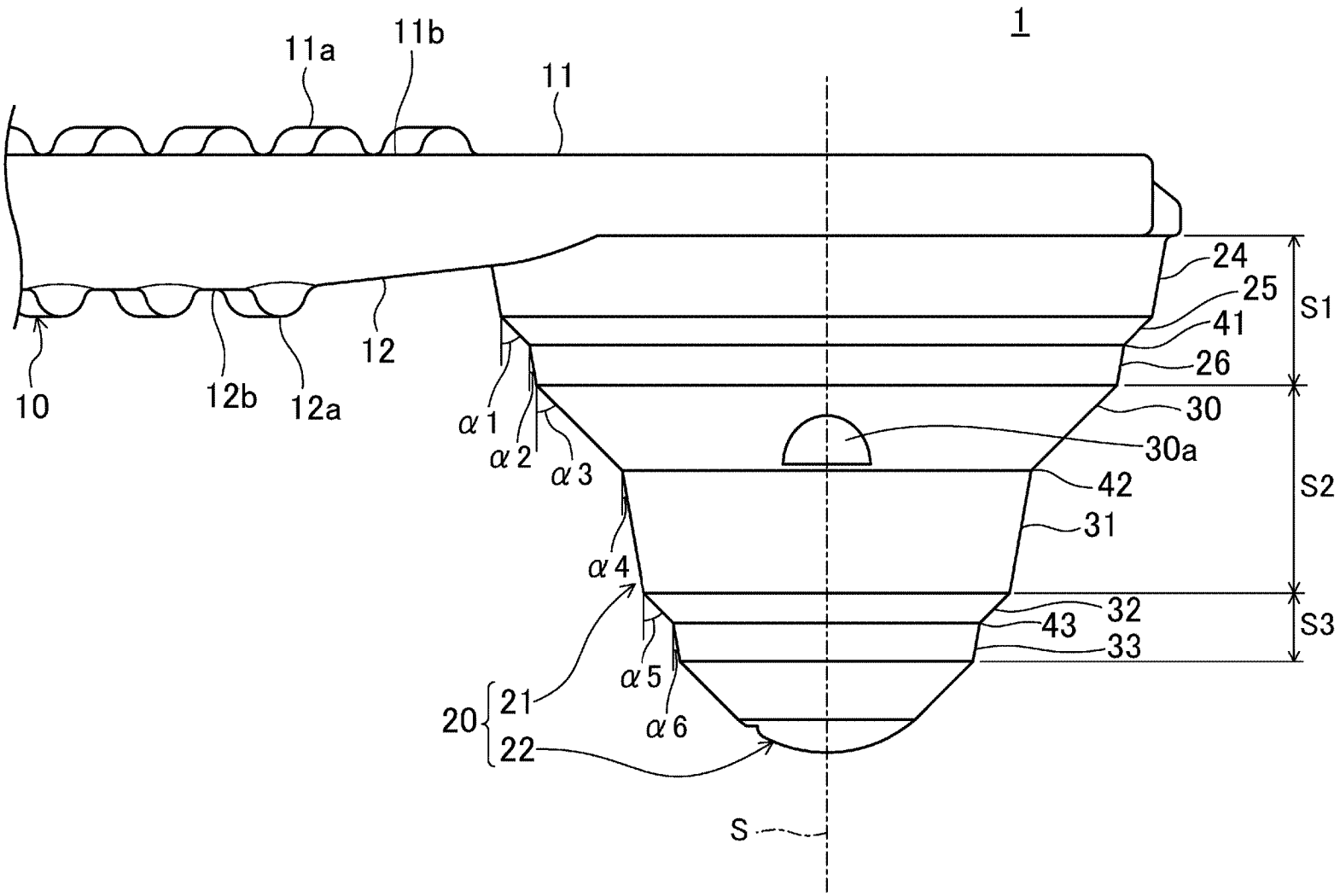
FIG. 5 is an enlarged side view illustrating the vicinity of a bulge according to the first embodiment.

As shown in FIGS. 1 and 5, the bulge 20 is provided at one of longitudinal ends of the base 10. The bulge 20 protrudes downward from the lower surface 12 of the base 10, and is empty inside to have a hollow portion R as shown in FIG. 6.

A through hole 13 is formed in the one of the longitudinal ends of the base 10 at a position corresponding to the bulge 20 to penetrate the base 10 in the vertical direction (a thickness direction of the base 10). The through hole 13 is a round hole, and communicates with the hollow portion R in the bulge 20. The through hole 13 thus formed opens the hollow portion R. As shown in FIG. 6, the upper surface 11 of the base 10 is provided with a recess 11*c* formed around the through hole 13.

As shown in FIGS. 3 and 4, a round through hole 14 is formed in an end of the base 10 opposite to the bulge 20. The through hole 14 allows the exercise tool 1 to be hanged on a hook or any other tools when the exercise tool 1 is in storage, or allows the user to hold the exercise tool 1 by inserting his or her finger in it.

Figure 6:
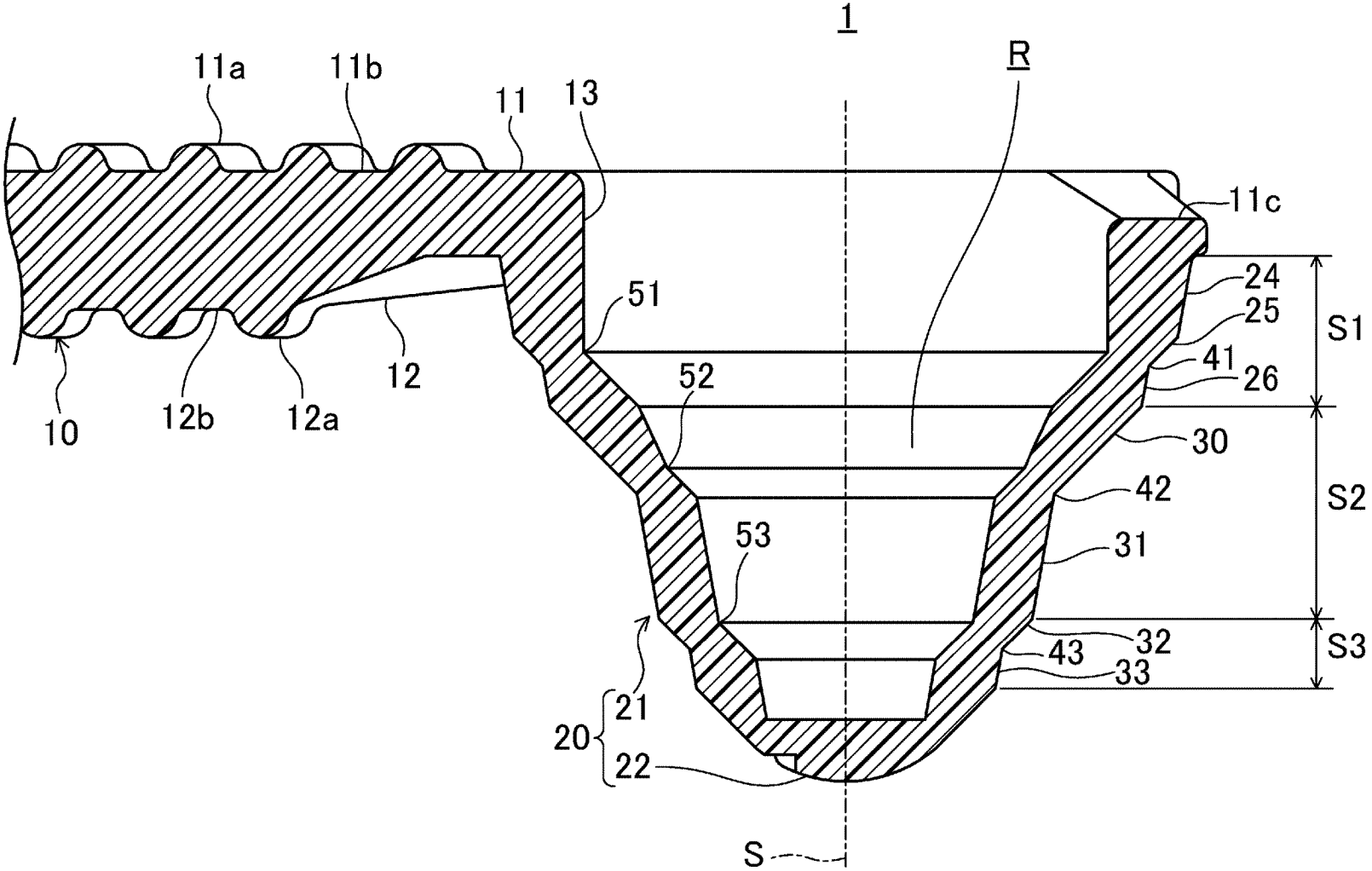
FIG. 6 is an enlarged cross-sectional view illustrating the vicinity of the bulge according to the first embodiment.

As shown in FIGS. 5 and 6, the bulge 20 is in the shape of a dome having an almost round cross section when cut along a direction orthogonal to a center line S extending in a protruding direction thereof, and the cross section orthogonal to the center line S is decreasing toward the protruding end. The bulge 20 has a peripheral wall 21 and an end wall 22. Further, as shown in FIG. 5, the peripheral wall 21 is roughly divided into a proximal region S1, an intermediate region S2 and a distal region S3.

The proximal region S1 includes a first inclined proximal wall portion 24 extending downward from the lower surface 12 of the base 10, a second inclined proximal wall portion 25 continuous from a lower end of the first inclined proximal wall portion 24, and a third inclined proximal wall portion 26 continuous from a lower end of the second inclined proximal wall portion 25. The first to third inclined proximal wall portions 24 to 26 are inclined such that a distance from the center line S decreases with a decreasing distance from the end wall 22. The first inclined proximal wall portion 24 is thicker than the other portion of the peripheral wall 21 lower than the first inclined proximal wall portion 24.

An inclination angle $\alpha 1$ of the second inclined proximal wall portion 25 relative to the center line S is larger than an inclination angle $\alpha 2$ of the third inclined proximal wall portion 26 relative to the center line S, and thus the second inclined proximal wall portion 25 is less steep than the third inclined proximal wall portion 26.

The second and third inclined proximal wall portions 25 and 26 constitute a first outer level difference portion 41 in a vertically intermediate region of an outer surface of the bulge 20. Further, as shown in FIG. 6, an inner surface of the bulge 20 is provided with a first inner level difference portion 51 corresponding to the first outer level difference portion 41.

A thickness of a portion of the bulge 20 between a valley of the first outer level difference portion 41 and a valley of the first inner level difference portion 51 is smaller than the thicknesses of the second and third inclined proximal wall portions 25 and 26. The valley designates a deepest portion of a recess forming the level difference portion.

As shown in FIG. 5, the intermediate region S2 includes a first inclined intermediate wall portion (corresponding to a first peripheral wall portion of the present invention) 30 continuous from a lower end of the third inclined proximal wall portion 26, and a second inclined intermediate wall portion (corresponding to a second peripheral wall portion of the present invention) 31 continuous from a lower end of the first inclined intermediate wall portion 30.

The first and second inclined intermediate wall portions 30 and 31 are inclined such that a distance from the center line S decreases with a decreasing distance from the end wall 22. An inclination angle $\alpha 3$ (corresponding to a first inclination angle of the present invention) of the first inclined intermediate wall portion 30 relative to the center line S is larger than the inclination angle $\alpha 2$ of the third inclined proximal wall portion 26 relative to the center line S, and thus the first inclined intermediate wall portion 30 is less steep than the third inclined proximal wall portion 26. Further, the first inclined intermediate wall portion 30 has a larger dimension than the third inclined proximal wall portion 26 in the vertical direction.

An inclination angle $\alpha 4$ (corresponding to a second inclination angle of the present invention) of the second inclined intermediate wall portion 31 relative to the center line S is smaller than the inclination angle $\alpha 3$ of the first inclined intermediate wall portion 30 relative to the center line S, and thus the second inclined intermediate wall portion 31 is steeper than the first inclined intermediate wall portion 30. Further, the first inclined intermediate wall portion 30 has a larger dimension than the second inclined intermediate wall portion 31 in the vertical direction.

The first and second inclined intermediate wall portions 30 and 31 constitute a second outer level difference portion 42 in the vertically intermediate portion of the outer surface of the bulge 20. Further, as shown in FIG. 6, the inner surface of the bulge 20 is provided with a second inner level difference portion 52 corresponding to the second outer level difference portion 42.

A valley of the second outer level difference portion 42 is located lower than a valley of the second inner level difference portion 52, and thus the valleys of the second outer and inner level difference portions 42 and 52 are misaligned with each other in the vertical direction. A thickness of a portion of the bulge 20 between the valleys of the second outer level difference portion 42 and the second inner level difference portion 52 is smaller than the thicknesses of the first and second inclined intermediate wall portions 30 and 31.

As shown in FIG. 5, the distal region S3 includes a first inclined distal wall portion 32 continuous from a lower end of the second inclined intermediate wall portion 31 and a second inclined distal wall portion 33 continuous from a lower end of the first inclined distal wall portion 32.

The first and second inclined distal wall portions 32 and 33 are inclined such that a distance from the center line S decreases with a decreasing distance from the end wall 22. The first inclined distal wall portion 32 has a larger dimension than the second inclined distal wall portion 33 in the vertical direction.

An inclination angle $\alpha$5 of the first inclined distal wall portion 32 relative to the center line S is larger than the inclination angle $\alpha$4 of the second inclined intermediate wall portion 31 relative to the center line S, and thus the first inclined distal wall portion 32 is less steep than the second inclined intermediate wall portion 31. The first and second inclined distal wall portions 32 and 33 constitute a third outer level difference portion 43 in the vertically intermediate portion of the outer surface of the bulge 20. Further, as shown in FIG. 6, the inner surface of the bulge 20 is provided with a third inner level difference portion 53 corresponding to the third outer level difference portion 43.

A valley of the third outer level difference portion 43 is located lower than a valley of the third inner level difference portion 53, and thus the valleys of the third outer level difference portion 43 and the third inner level difference portion 53 are misaligned with each other in the vertical direction. A thickness of a portion of the bulge 20 between the valleys of the third outer level difference portion 43 and the third inner level difference portion 53 is smaller than the thicknesses of the first and second inclined distal wall portions 32 and 33.

The inclination angle $\alpha$3 of the first inclined intermediate wall portion 30 relative to the center line S is larger than the other inclination angles $\alpha$1, $\alpha$2 and $\alpha$4-$\alpha$6, and thus the first inclined intermediate wall portion 30 is the least steep portion of the peripheral wall 21. Therefore, when the bulge 20 is pressed in the direction of the center line S, the first inclined intermediate wall portion 30 is deformed most easily, while the portions above and below the first inclined intermediate wall portion 30 are deformed less easily than the first inclined intermediate wall portion 30.

Figure 7:
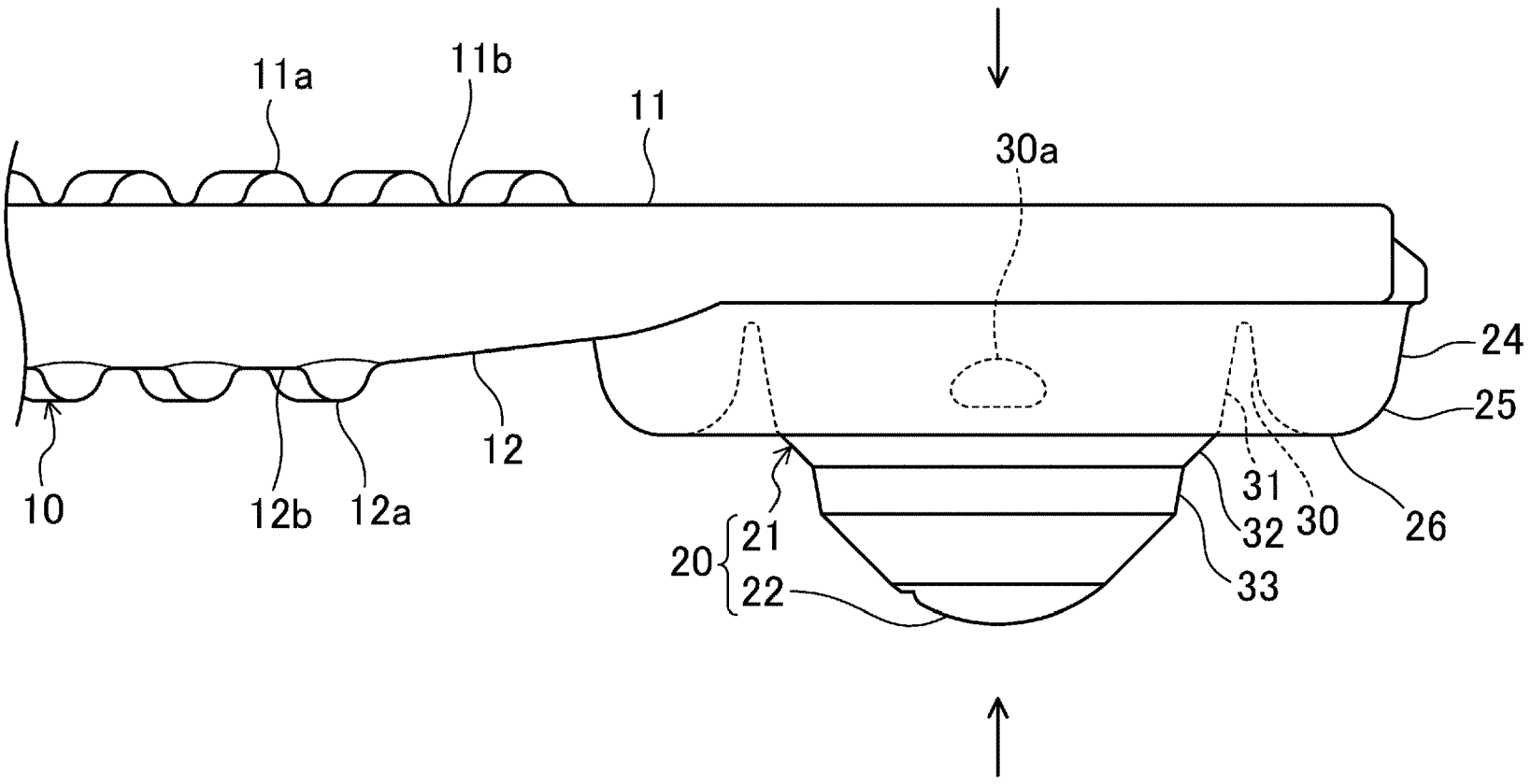
FIG. 7 is a view corresponding to FIG. 5, illustrating the bulge according to the first embodiment crushed.

When the bulge 20 is pressed in the direction of the center line S, the first inclined intermediate wall portion 30 is elastically deformed toward the inside of the bulge 20 (upward when the tool 1 is in use) with the vicinity of the first outer and inner level difference portions 41 and 51 serving as a starting point (see FIG. 7). In this state, the second inclined intermediate wall portion 31 is also elastically deformed and displaced upward in response to the upward bend of the first inclined intermediate wall portion 30. Thus, the first and second inclined intermediate wall portions 30 and 31 overlap with each other such that their outer surfaces come into contact with each other.

As can be seen in the foregoing, the portions of the peripheral wall 21 are preferably inclined relative to the center line S. Further, as shown in FIG. 4, when the peripheral wall 21 is viewed from its end, boundaries of the inclined wall portions 24-33 form circles. Intervals between the boundaries vary depending on the inclination angles and vertical dimensions of the inclined wall portions 24-33. The intervals between the boundaries are preferably non-uniform.

The end wall 22 is continuous from a lower end of the second inclined distal wall portion 33, and is curved smoothly to protrude downward.

As shown in FIG. 4, an outer surface of the first inclined intermediate wall portion 30 is provided with two projections 30*a*, 30*a* formed to have intervals therebetween in a circumferential direction of the bulge 20. As shown in FIG. 7, the protrusions 30*a* come into contact with the outer surface of the second inclined intermediate wall portion 31 when the bulge 20 is pressed in the direction of the center line S and the first and second inclined intermediate wall portions 30 and 31 overlap with each other.

How the exercise tool 1 for improving oral function configured as described above is used will now be described. First, as shown in FIG. 2, one of the longitudinal ends of the base 10 provided with the bulge 20 is inserted in an oral cavity of a user, and the insertion is stopped when the bulge 20 touches a tongue. In this state, the other longitudinal end of the base 10 protrudes outside the oral cavity. Since the base 10 is provided with the upper and lower grooves 11*b* and 12*b* to help the base 10 bend and become deformed, the base 10 is allowed to be elastically deformed along the shape of the oral cavity.

In FIG. 2, a phantom line indicates the shape of the bulge 20 before deformation, and a solid line indicates the shape of the deformed bulge 20.

Thereafter, the user bites the base 10 between the front teeth A, B. Then, the upper front teeth A fit into the upper groove 11*b*, while the lower front teeth B fit into the lower groove 12*b*. In this state, since the upper and lower grooves 11*b* and 12*b* are curved to correspond to the rows of the upper and lower front teeth A and B, respectively, the front teeth A and B fit into the grooves 11*b* and 12*b* with reliability when the user bites the base 10 naturally. Further, in general, lower ends of the upper front teeth A and upper ends of the lower front teeth B of the user are misaligned with each other in a longitudinal direction of the user. In this embodiment, since the upper and lower grooves 11*b* and 12*b* are misaligned with each other in the longitudinal direction of the user, the front teeth A and B fit into the grooves 11*b* and 12*b* with reliability when the user bites the base 10 naturally. Thus, the base 10 is fixed stably to the user.

To position the bulge 20 in the oral cavity in the insertion direction, the base 10 is merely moved into or out of the oral cavity. In this case, since the base 10 is provided with the plurality of upper and lower grooves 11*b* and 12*b*, the front teeth A and B fit into the grooves 11*b* and 12*b* with reliability by only biting the base 10 after the positioning. Thus, if a single exercise tool 1 is used among a plurality of users of different sexes and physiques, the bulge 20 is arranged at a position suitable for each user.

Thereafter, the user starts the exercise. That is, the user first pushes his or her tongue upward. Then, the bulge 20 is sandwiched between the tongue and a hard palate, and a force is exerted on the bulge 20 to crush the bulge 20 in the vertical direction. The bulge 20 is provided with the first and second outer level difference portions 41 and 42 and the first and second inner level difference portions 51 and 52. Thus, if the force applied by the tongue reaches or exceeds a predetermined level, these level difference portions 41, 42, 51 and 52 serve as starting points of elastic deformation, and the first inclined intermediate wall portion 30 undergoes a sudden upward elastic deformation with the vicinity of the first outer level difference portion 41 and the first inner level difference portion 51 serving as starting points such that the distal region S3 of the bulge 20 approaches the proximal region S1 (see FIG. 7), and at the same time, the second inclined intermediate wall portion 31 is suddenly displaced upward. As a result, the first and second inclined intermediate wall portions 30 and 31 overlap with each other. The bulge 20 vibrates at the instant when such a sudden elastic deformation occurs, and the vibration is transferred to the tongue and the hard palate, and then is felt by the user. When the bulge 20 is elastically deformed, a sound that the user can hear is also generated.

In this embodiment, the bulge 20 has a hardness of 30 to 60. Thus, the bulge 20 clearly generates the vibration at the instant when the elastic deformation occurs, and even a senior citizen having a relatively week tongue muscle is able to crush the bulge 20 with his or her tongue. That is, if the hardness of the bulge 20 is less than 30, the bulge 20 is elastically deformed entirely without undergoing a sudden, partial elastic deformation, and thus the vibration that can be felt by the user is not generated. On the other hand, the hardness of the bulge 20 more than 60 makes the bulge 20 too hard to crush with the user's tongue, and makes the user uncomfortable when the bulge 20 comes into contact with oral mucosa. Thus, the bulge 20 preferably has a hardness in the above-described range. More preferably, the hardness is in a range of 35 to 55.

Further, in this embodiment, in addition to the first and second outer level difference portions 41 and 42 and the first and second inner level difference portions 51 and 52, the third outer level difference portion 43 and the third inner level difference portion 53 are also provided. Thus, if the upward force applied by the tongue increases, the third outer level difference portion 43 and the third inner level difference portion 53 serve as starting points of the elastic deformation, and the first and second inclined distal wall portions 32 and 33 of the distal region S3 undergo a sudden elastic deformation with the vicinity of the level difference portions 43 and 53 serving as a starting point. The bulge 20 also vibrates through this elastic deformation.

A force required to start the elastic deformation of the bulge 20 may be set arbitrarily depending on the depths of the first to third outer level difference portions 41-43 and the first to third inner level difference portions 51-53, the thickness of the first inclined intermediate wall portion 30 and any other suitable parameters. If the force required to start the deformation is too small, the exercise does not work on muscles, and if the force required to start the deformation is too large, the bulge 20 cannot be crushed. Thus, in this embodiment, the force required to start the elastic deformation is set to such a level that allows the user to deform the bulge many times repeatedly so that the exercise improves the oral function.

When the force applied by the tongue is released with the bulge 20 being elastically deformed as described above, the bulge 20 recovers its original shape due to its elasticity. In this state, according to this embodiment, the recess 11*c* is formed around the through hole 13 so that the oral mucosa does not completely close the through hole 13. Thus, the air easily enters from outside to the hollow portion R of the bulge 20 via the through hole 13, thereby preventing the bulge 20 recovering its original shape from sticking to the mucosa. This allows for protecting the mucosa from damage.

When the first and second inclined intermediate wall portions 30 and 31 overlap with each other, the projections 30*a*, 30*a* come into contact with the outer surface of the second inclined intermediate wall portion 31. This allows for preventing excessive deformation of the first and second inclined intermediate wall portions 30 and 31. Then, the contact of the projections 30*a*, 30*a* exerts a force in a direction along which the wall portions 30 and 31 return to their original positions, thereby allowing the bulge 20 to recover its original shape with reliability.

In this embodiment, the projections 30*a*, 30*a* are provided on the first inclined intermediate wall portion 30. However, the projections 30*a*, 30*a* may be provided on a different position, for example, on the second inclined intermediate wall portion 31 (not shown).

Repeating the raising and lowering of the tongue allows for strengthening oral and facial muscles.

As can be seen in the foregoing, when doing the exercise, what the user needs to do is simply press the bulge with his or her tongue until the vibration occurs. Thus, the user is able to know clearly how much he or she should press the bulge to obtain the effect of the exercise, and an effective exercise is achievable. Further, the occurrence of the vibration allows the user to realize that he or she is doing the exercise properly.

Since the tongue is moved during the exercise, secretion of saliva is accelerated. The saliva in the oral cavity enters, and is retained in, the upper grooves 11*b* formed in the upper surface 11 of the base 10. Thus, the saliva does not easily leak out of the oral cavity.

As can be seen in the foregoing, according to the exercise tool 1 for improving oral function of the first embodiment, the hollow bulge 20 made of an elastic body is provided with the level difference portions 41, 42, 51 and 52. Thus, when a force is gradually applied to the bulge by a tongue, the bulge 20 undergoes a sudden elastic deformation with the level difference portions 41, 42, 51 and 52 serving as a starting point of the deformation. This allows a user to do an effective exercise for improving oral function and to realize during the exercise that he or she is doing the exercise properly so as to increase the user's motivation. As a result, the oral function is effectively improvable.

Further, the exercise tool also allows for strengthening muscles around the oral cavity. This may also provide beauty effects, such as tightening the face.

Further, in the above-described embodiment, the first to third outer level difference portions 41-43 are provided in the outer surface of the bulge 20 and the first to third inner level difference portions 51-53 are provided in the inner surface of the bulge 20. However, this configuration of the outer and inner level difference portions is not a limiting one, and the first to third outer level difference portions 41-43 or the first and inner level difference portions 51-53 may be omitted.

If the first to third outer level difference portions 41-43 are omitted, the bulge 20 would have a smooth outer surface. However, the first to third inner level difference portions 51-53 serve as a starting point of the elastic deformation, and thus the bulge 20 undergoes a sudden elastic deformation. Further, if the first to third inner level difference portions 51-53 are omitted, the bulge 20 would have a smooth inner surface. However, the first to third outer level difference portions 41-43 serve as a starting point of the elastic deformation, and thus the bulge 20 undergoes a sudden elastic deformation.

Second Embodiment

Figure 8:
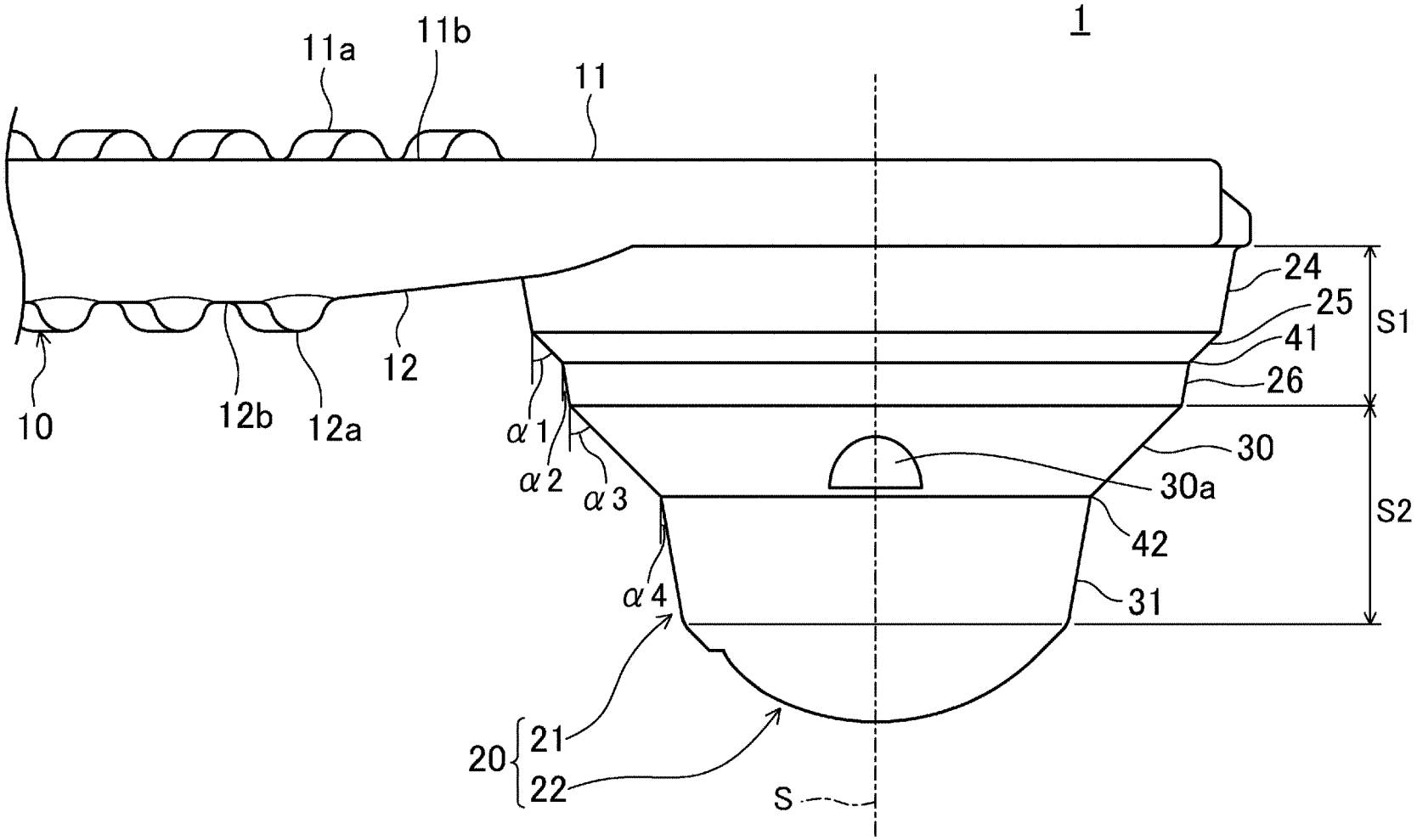
FIG. 8 is a view corresponding to FIG. 5, illustrating a second embodiment.
Figure 9:
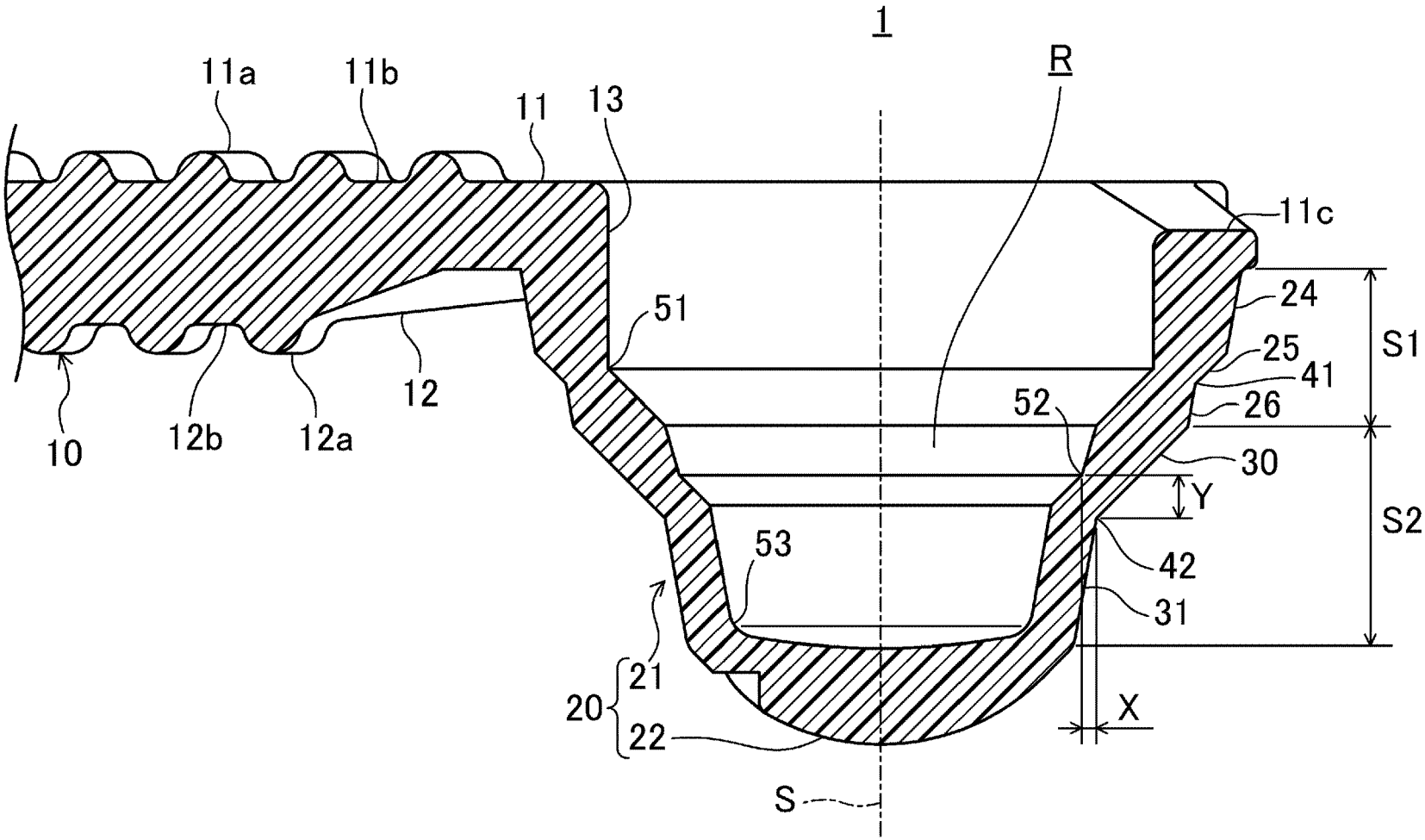
FIG. 9 is a view corresponding to FIG. 6, illustrating the second embodiment.

FIGS. 8 and 9 show an exercise tool 1 for improving oral function according to a second embodiment of the present invention. The exercise tool 1 for improving oral function according to the second embodiment is different from that of the first embodiment only in the shape of the bulge 20, and the other features are the same as those of the first embodiment. Thus, the different between the first and second embodiments will be described in detail.

That is, the bulge 20 of the second embodiment does not have the third outer level difference portion 43 and the third inner level difference portion 53. Further, as shown in FIG. 9, the end wall 22 of the bulge 20 of the second embodiment is thicker than that of the first embodiment. In addition, the second inclined intermediate wall portion 31 of the bulge 20 of the second embodiment is thinner than that of the first embodiment.

Since the end wall 22 is made thicker, the end wall 22 increases in rigidity. Further, a portion of the base 10 around the through hole 13 is made thicker than the second inclined intermediate wall portion 31, and thus the portion of the base 10 around the through hole 13 also increases in rigidity. Thus, a portion of the bulge 20 between the end wall 22 and the base 10, that is, the peripheral wall 21, is sandwiched between the portions having higher rigidity than the peripheral wall 21. Therefore, if a force is exerted on the bulge 20 in the vertical direction, the force is exerted reliably on the peripheral wall 21 to cause a sudden elastic deformation of the peripheral wall 21, while making the base 10 and the end wall 22 less deformed. The peripheral wall 21 is elastically deformed so as to be housed in the through hole 13 of the base 10, which allows for ensuring sufficient deformation of the peripheral wall 21.

A valley (a deepest portion) of the second outer level difference portion 42 and a valley (a deepest portion) of the second inner level difference portion 52 are away from each other in the direction of the center line S of the bulge 20, and also in the direction orthogonal to the center line S.

If a distance between the valleys of the second outer level difference portion 42 and the second inner level difference portion 52 in a direction orthogonal to the protruding direction (the direction of the center line S) is regarded as X, and a distance between the valleys of the second outer level difference portion 42 and the second inner level difference portion 52 in the protruding direction is regarded as Y, the distances are determined such that X is not more than Y. Specifically, in this embodiment, X is 0.5 mm, Y is 1.5 mm, and thus X is ⅓ of Y. The values X and Y may be different from the above-described ones as long as predetermined conditions are met. X may be less than ⅓ of Y.

The bulge 20 is elastically deformed with the level difference portions 41, 42, 51 and 52 serving as a starting point of the deformation. When the bulge 20 is pressed in the direction of the center line S, a maximum load is applied just before the elastic deformation of the bulge 20, and a minimum load is applied just after the elastic deformation. The maximum and minimum loads may be determined depending on the distances X and Y, the depths of the level difference portions 41, 42, 51 and 52, the thickness of the peripheral wall 21 and any other suitable parameters. In this embodiment, regarding the maximum load as W1 and the minimum load as W2, W2 is not more than ½ of W1.

Figure 10:
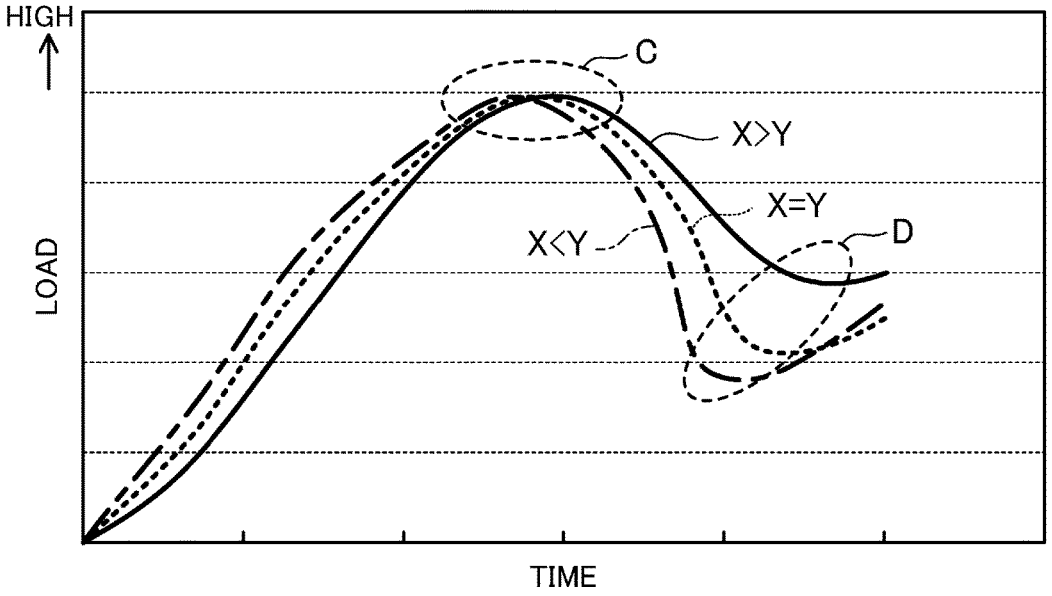
FIG. 10 is a graph illustrating relationship between time and load when a bulge according to the second embodiment is elastically deformed.

FIG. 10 is a graph showing relationship between elapsed time and variation in load obtained when the bulge 20 of the exercise tool 1 for improving oral function was crushed using a universal testing machine (TENSILON universal testing machine). In FIG. 10, a lateral axis of the graph represents time, and a vertical axis represents the load. A head speed of the TENSILON testing machine was 20 mm/min.

The exercise tool 1 for improving oral function was placed on a hard board which was not easily deformed during the test with the end wall 22 turned up and the center line S of the bulge 20 extending perpendicularly. A head of the testing machine was arranged to face the end wall 22, and was moved downward at a constant speed to crush the bulge 20.

In FIG. 10, a dotted line indicates the results obtained when X<Y (X:Y=1:3), a broken line indicates the results obtained when X=Y, and a solid line indicates the results obtained when X>Y (X:Y=3:1). Further, in FIG. 10, the maximum load W1 is applied in a circled region C, and the minimum load W2 is applied in a circled region D. In all the three cases, the maximum loads W1 are substantially equal and applied at almost the same period, but the minimum loads W2 are different in magnitude and applied at different periods of time.

When X<Y, the minimum load W2 is not more than ½ of the maximum load W1, and the inclination of the graph is steep from when the maximum load W1 is applied to when the minimum load W2 is applied. This indicates that the load has varied significantly and suddenly. In this case, the bulge 20 generates vibration that the user can feel clearly.

When X=Y, the minimum load W2 is not more than ½ of the maximum load W1, which indicates that the load has varied significantly and suddenly. Thus, the bulge 20 generates vibration that the use can feel clearly.

On the other hand, when X>Y, the minimum load W2 is about 60% of the maximum load W1. Further, the inclination of the graph is less steep than the other graphs from when the maximum load W1 is applied to when the minimum load W2 is applied. This indicates that the load has varied slightly and slowly. Thus, the vibration generated by the bulge 20 may be too small for the user to feel clearly.

If the hardness of the material is in a range of 30 to 60, the similar results would be obtained.

As can be seen in the foregoing, the exercise tool 1 for improving oral function according to the second embodiment allows for providing the advantages similar to those of the first embodiment.

Further, the distance X between the valleys of the second outer level difference portion 42 and the second inner level difference portion 52 in a direction orthogonal to the protruding direction is set to be not more than the distance Y between the valleys of the second outer level difference portion 42 and the second inner level difference portion 52 in the protruding direction. Thus, when the exercise tool 1 is in use, the bulge 20 easily undergoes a sudden elastic deformation, which allows the user to realize more clearly that he or she is doing the exercise properly.

When X is not more than ⅓ of Y, the bulge 20 undergoes a more sudden elastic deformation when the exercise tool 1 is in use. Thus, X is preferably not more than ⅓ of Y.

Further, the minimum load W2 applied when the bulge 20 is elastically deformed is not more than ½ of the maximum load W1. This also makes it possible to increase the vibration generated by the bulge 20 in use of the exercise tool 1, which allows the user to realize more clearly that he or she is doing the exercise properly.

In the first and second embodiments, at least one level difference portion may be provided in the outer surface of the bulge, 20, and at least one level difference portion may be provided in the inner surface of the bulge 20.

In the first and second embodiments, the description has been made on an example where the bulge 20 is configured to protrude downward. However, the configuration of the bulge 20 is not limited thereto, and the bulge 20 may protrude upward. Alternatively, two bulges, i.e., a bulge protruding upward and a bulge protruding downward, may be provided.

If a plurality of bulges are provided, they may be arranged in the longitudinal or width direction of the base 10.

In the first and second embodiments, the base 10 and the bulge 20 are integrally molded. However, they may be molded separately, and then joined together into a one piece. In such a case, the base 10 and the bulge 20 may be made of different materials.

Further, the shape of the base 10 is not limited to the shape described above, and the upper and lower ribs 11*a* and 12*a* may be omitted. Moreover, the base 10 is in the shape of a stick.

An end face of the bulge 20 is not always curved. For example, the end face may be a flat surface extending in a direction intersecting with the center line S.

The bulge 20 may be pressed with a tip of a tongue to do the exercise.

Moreover, with the upper and lower teeth met each other, the bulge 20 may be arranged between the side of back teeth and an inner surface of a cheek to have the end face of the bulge 20 facing the cheek. Then, cheek muscle presses the bulge 20 against the back teeth to cause the elastic deformation of the bulge 20.

In addition, the bulge 20 may be sandwiched between upper and lower lips so that the bulge 20 is crushed in the vertical direction by the lips.

Further, in the first and second embodiments, the description has been made on an example where the bulge 20 has a round cross section cut along the direction orthogonal to the center line S. However, the cross-sectional shape of the bulge 20 is not limited thereto, and may be polygonal.

INDUSTRIAL APPLICABILITY

As can be seen in the foregoing, an exercise tool for improving oral function according to the present invention is usable for strengthening oral muscles such as a tongue and facial muscles.

DESCRIPTION OF REFERENCE CHARACTERS

1 Exercise Tool for Improving Oral Function
10 Base Portion
20 Bulge
30 Intermediate Inclined Portion (First Peripheral Wall Portion)
31 First Inclined Distal Wall Portion (Second Peripheral Wall Portion)
41 First Outer Level Difference Portion
42 Second Outer Level Difference Portion
43 Third Outer Level Difference Portion
51 First Inner Level Difference Portion
52 Second Inner Level Difference Portion
53 Third Inner Level Difference Portion
R Hollow Portion
S Center Line

The invention claimed is:

1. A tongue exercise tool comprising:
a plate-like base adapted to be inserted into an oral cavity of a user; and
an elastically deformable hollow bulge which is made of an elastic body and protrudes from a longitudinal end of the plate-like base,
wherein:
a level difference portion is provided in an intermediate region of at least one of an outer surface or an inner surface of the bulge in a protruding direction thereof
a peripheral wall of the bulge includes a first peripheral wall portion inclined at a first inclination angle relative to the protruding direction, and a second peripheral wall portion inclined relative to the protruding direction at a second inclination angle smaller than the first inclination angle, and
the first and second peripheral wall portions are continuous in the protruding direction of the bulge, and constitute the level difference portion.

2. The tongue exercise tool of claim 1, wherein
the first peripheral wall portion has a greater length in the protruding direction than the second peripheral wall portion.

3. The tongue exercise tool of claim 1, wherein
the level difference portion is provided in each of the outer and inner surfaces of the bulge.

4. The tongue exercise tool of claim 3, further comprising:
an outer level difference portion provided in the outer surface of the bulge and an inner level difference portion provided in the inner surface of the bulge, wherein
a valley of the outer level difference portion and a valley of the inner level difference portion are misaligned with each other in the protruding direction of the bulge, and
if a distance between the valleys of the outer and inner level difference portions in a direction orthogonal to the protruding direction is regarded as X and a distance between the valleys of the outer and inner level difference portions in the protruding direction is regarded as Y, X is not more than Y.

5. The tongue exercise tool of claim 4, wherein
X is not more than ⅓ of Y.

6. The tongue exercise tool of claim 1, further comprising:
an outer level difference portion provided in the outer surface of the bulge and an inner level difference portion provided in the inner surface of the bulge, wherein
a valley of the outer level difference portion and a valley of the inner level difference portion are misaligned with each other in the protruding direction of the bulge, and a portion of the bulge between the valleys of the outer and inner level difference portions is thinner than the other portions of the bulge.

7. The tongue exercise tool of claim 1, wherein
the first and second peripheral wall portions are configured to overlap with each other when a force is exerted on the bulge in a direction in which the bulge is crushed, and
a projection is formed on at least one of outer surfaces of the first and second peripheral wall portions so that the projection comes into contact with the other outer surface when the first and second peripheral wall portions overlap with each other.

8. The tongue exercise tool of claim 1, wherein
if a maximum load applied before the bulge is elastically deformed with the level difference portion serving as a starting point of the deformation is regarded as W1 and a minimum load applied just after the bulge is elastically deformed is regarded as W2, W2 is not more than ½ of W1.

* * * * *